US006243250B1

(12) United States Patent
Cater

(10) Patent No.: US 6,243,250 B1
(45) Date of Patent: Jun. 5, 2001

(54) ELECTRICAL CONNECTOR

(75) Inventor: Evan John Cater, Bateau Bay (AU)

(73) Assignee: Krone GmbH (DE)

( * ) Notice: Subject to any disclaimer, the term of this patent is extended or adjusted under 35 U.S.C. 154(b) by 0 days.

(21) Appl. No.: 09/294,589

(22) Filed: Apr. 20, 1999

(30) Foreign Application Priority Data

Apr. 20, 1998 (AU) ..... PP3084

(51) Int. Cl.[7] ..... H01C 7/12
(52) U.S. Cl. ..... 361/119; 361/111
(58) Field of Search ..... 361/119, 111, 361/117–118, 824; 379/412

(56) References Cited

U.S. PATENT DOCUMENTS

| | | | | |
|---|---|---|---|---|
| 4,729,064 | * | 3/1988 | Singer, Jr. | 361/426 |
| 4,822,306 | | 4/1989 | Klaiber . | |
| 5,435,747 | | 7/1995 | Franckx et al. . | |
| 5,543,999 | | 8/1996 | Riley . | |
| 5,546,267 | * | 8/1996 | Frederiksen et al. | 361/119 |
| 5,574,615 | | 11/1996 | Busse et al. . | |
| 5,596,475 | * | 1/1997 | Figueiredo et al. | 361/119 |
| 5,627,721 | * | 5/1997 | Figueiredo et al. | 361/119 |
| 5,696,820 | * | 12/1997 | Pelegris et al. | 379/399 |
| 5,779,504 | | 7/1998 | Dominiak et al. . | |
| 5,999,412 | | 12/1999 | Busse et al. . | |

FOREIGN PATENT DOCUMENTS

| | | |
|---|---|---|
| 38 37 051 C1 | 3/1990 | (DE) . |
| 40 05 076 A1 | 8/1991 | (DE) . |
| 800 192 A1 | 10/1997 | (EP) . |
| 2 530 910 | 1/1984 | (FR) . |
| 2 714 221 | 6/1995 | (FR) . |
| 2 117 577A | 10/1983 | (GB) . |

* cited by examiner

*Primary Examiner*—Michael J. Sherry
(74) *Attorney, Agent, or Firm*—McGlew and Tuttle, P.C.

(57) ABSTRACT

Electrical connector (8) having connector terminals (12) at a front thereof to which external electrical conductors may be secured to make electrical connections between the conductors and the first terminals (12). A mounting assembly (14) at a rear of the connector (8) receives over-voltage protection devices (18) so that these couple electrically to the connector terminals (12) for providing over-voltage protection to electrical circuits in use coupling to the connector terminals (12). A releasable mounting device (20) releasably connects of the connector (8) to support structure (22) for the connector.

20 Claims, 4 Drawing Sheets

ELECTRICAL CONNECTOR

FIELD OF THE INVENTION

This invention relates to an electrical connector having first terminals at a front thereof, and to which external electrical conductors may be secured to make electrical connections between the conductors and the first terminals, the connector being adapted to receive over-voltage protection devices so that the over-voltage protection devices are then coupled electrically to the first terminals for providing over-voltage protection to electrical circuits in use coupling to the first terminals via the external conductors, and releasable mounting means for releasable connection of the connector to support structure for the connector, wherein the connector has a mounting assembly positioned at the rear of the connector for receiving the over-voltage protection devices.

BACKGROUND OF THE INVENTION

Electrical connectors having terminals, such as for making releasable electrical connection to electrical conductors of a communications network, may be arranged to receive over-voltage protection devices which, in the event of an over-voltage condition on a conductor, act to provide a conductive path to ground. Such devices may be connected across respective pairs of conductors associated with respective communications circuits. Each over-voltage device may comprise a three terminal device, first and third terminals of which are in use connected to respective conductors of the pair with which it is associated. The second terminal is connected to ground. Under the condition of normal voltage across such a device, the device presents a high impedance as between all terminals, but under over-voltage conditions on either the first or second terminals, breakdown occurs to provide a conductive path from the terminal exhibiting the over-voltage to ground (earth). The provision of devices of this type is important in practical communications systems to prevent over-voltage conditions, arising for example from lightning strikes, from causing serious damage to the system.

Practically, in for example a telephone exchange, the connectors which releasably connect to the network conductors are arranged on suitable support structure with the terminals facing outwardly for ease of access, bearing in mind that alterations to the connections from the connector terminals to the conductors may need to be frequently made, to accommodate the needs of network users. In such a construction, the over-voltage protection devices may then be mounted to the fronts of the connectors. This mounting arrangement is convenient from the point of view of ease of access, since the over-voltage devices themselves may need to be accessed for replacement. However, mounting these in this fashion is also inconvenient in that the devices are then adjacent the connector terminals and inhibit convenient access to the connector terminals.

SUMMARY AND OBJECTS OF THE INVENTION

It is an object of the invention to provide an electrical connector which may be arranged for receiving over-voltage such as to permit ready access to the connector terminals, and to permit access to the over-voltage devices in a simple manner.

In one aspect, the invention has a connector with a mounting assembly positioned at the rear of the connector for receiving the over-voltage protection devices.

The releasable mounting means may at least in part be formed by a conductive ground element, which in use of the connector makes releasable electrical connection to the support structure such that an electrical ground (earth) path is formed from the connector to an grounded (earthed) conductive portion of the support structure.

The first terminals may be carried by an insulative body of the connector, the mounting assembly having second terminals electrically connected to ones of the first terminals, the mounting assembly being adapted to receive the over-voltage protection devices so that these connect to the second terminals such that the over-voltage protection devices are coupled to the first terminals via the second terminals.

The mounting assembly may have an insulative structure and a circuit board, the second terminals being carried by the insulative structure and being electrically coupled to conductive tracks of the circuit board which are electrically coupled to the first terminals.

An electrically conductive ground (earth) element may be provided, in use of the connector forming part of or otherwise electrically coupling to the releasable mounting means, to provide a ground (earth) connection to the over-voltage protection devices. In one form, the ground element is arranged to releasably connect to the insulative body of the connector. Also in a particular form, the ground element may have gripping portions which are adapted to releasably grip the support structure to effect the releasable connection of the connector to the support structure. In the latter case, the gripping portions may be resilient and positioned adjacent to respective opposed portions of the connector, such that parts of the support structure may be resiliently gripped between the gripping portions and the opposed portions of the connector. The opposed portions may be formed on the ground element so that each gripping portion and its opposed portion define therebetween a respective rearwardly facing opening for receiving a respective part of the support structure. There may be a gripping portion and an associated opposed portion of the ground element at each end of the ground element.

A cover may be provided, covering the rear of the connector. This may be releasably attached to the insulative body of the connector.

The insulative body of the connector and the first terminals may form parts of a disconnection module, the first terminals being arranged in two parallel rows so that pairs of the first terminals, each comprising a first terminal in one row and an opposed first terminal in the other row, are defined, the first terminals having respective resilient contact portions, the resilient contact portions of the first terminals in each pair thereof being arranged so that in a first condition thereof they are resiliently biased into electrical contact with each other but, in a second condition thereof, are displaced out of direct electrical contact, by insertion of, for example, a test plug or an electrically insulative element therebetween so that they are forced apart against the resilient bias. In this arrangement, the resilient contact portions of each pair are electrically coupled in the first condition of these, and disconnected in the second condition. In arrangements of this kind, only the first terminals in one row of the first terminals may be arranged to be coupled to the over-voltage devices.

There may for example, be two spaced parallel rows of the second terminals, with an elongate portion of the ground element being positioned to extend parallel to and between the rows. The elongate portion of the ground element may be generally planar and arranged to form an outstanding barrier between ones of the over-voltage devices positioned at either face thereof. The elongate portion may have projections which connect to conductive tracks on the circuit board and thence via those tracks to ones of the second terminals.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
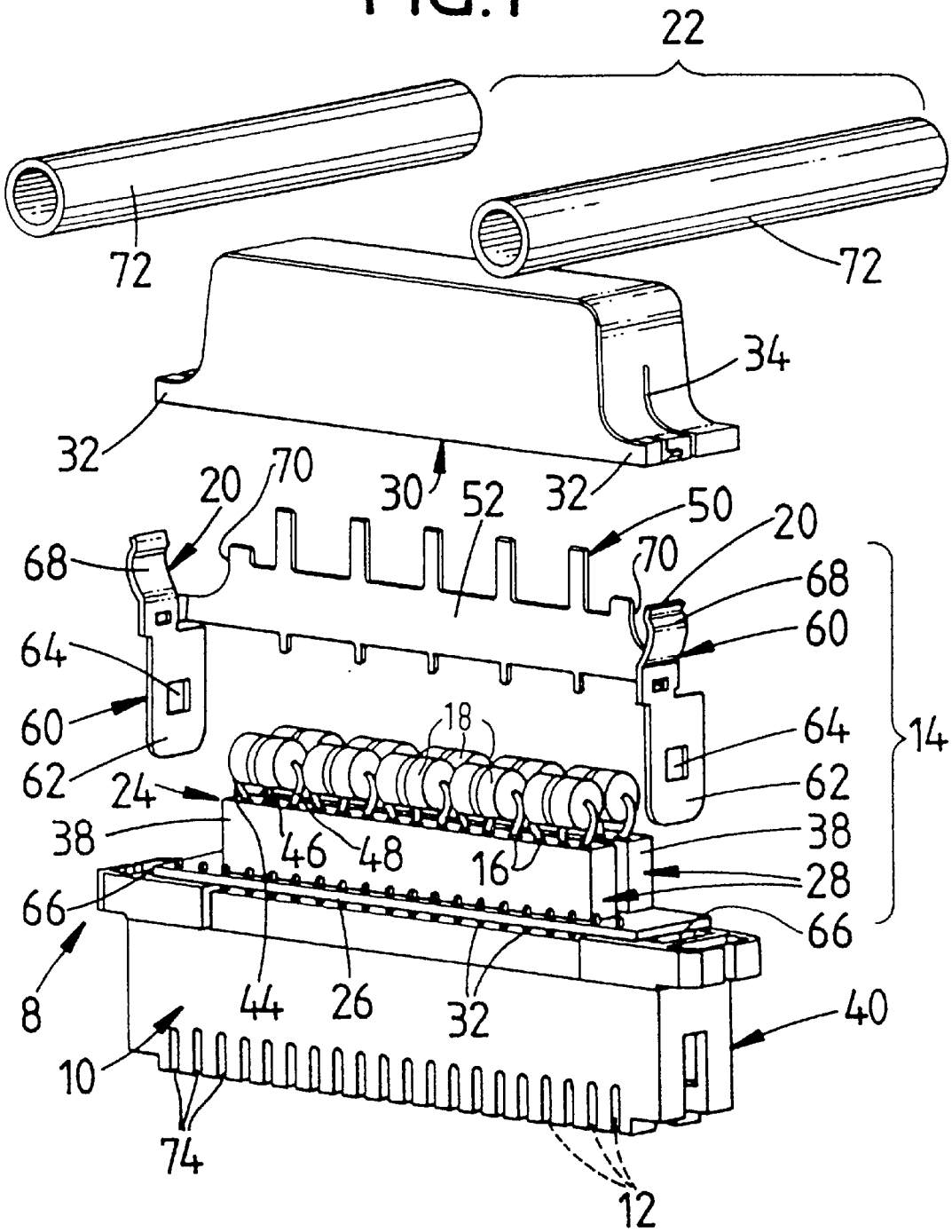
FIG. 1 is an exploded perspective view of an electrical connector constructed in accordance with the invention, and support structure with which the connector is used.

Referring to the drawings in particular, an electrical connector 8 is shown which is designed to be releasably secured to a support structure 22, in this case, formed by spaced parallel rails 72.

Connector 8 has an electrically insulative body 10 on a front face of which are positioned connector terminals 12 to which, in use of the connector, insulated wire conductors of communications circuits are connected. The terminals 12 are of the insulation displacement type, having bifurcated outer ends defining opposed resilient arms between which an insulated wire conductor can be pressed, so that inner edges of the arms cut the insulation and are resiliently urged into contact with the conductor, so that the conductor is gripped by the arms which then make electrical connection to the conductor.

The front face of the body 10 is of elongate rectangular form and the terminals 12 are arranged at this in two spaced parallel rows which extend parallel to the longer sides of the front face. The bifurcated ends of the terminals 12 are accommodated in cavities 74 which are accessible via slots at the front face of the body 12, so as to permit wire conductors to easily be connected to these.

At the rear face of the body 10, the connector 10 is fitted with a mounting assembly 14 having a printed circuit board 26 and, mounted on this, an insulative structure 24 formed of the insulative bodies 38 of two over-voltage device connectors 28. As described later, certain of the terminals 12 are soldered or otherwise electrically connected to tracks on the printed circuit board 26. Tracks on the printed circuit board 26 are also connected, such as by soldering, to mounting assembly terminals 16 carried by the insulative bodies 38 forming parts of the connectors 28.

The terminals 16 are of a kind permitting the making of electrical connection to wires insertable into them, by clamping action as an end of the wire is pressed into the terminal. Over-voltage protection devices 18 are electrically connected to the connectors 28, by so inserting wires 44, 46, 48 of each device 18 into respective ones of the terminals 16, so that the then-gripped wires make electrical connection via the tracks on the printed circuit board 26 to the terminals 12 (see FIG. 4). The devices 18 are in this instance gas arresters, these being gas-filled devices having a central terminal to which wire 46 is connected and outer end terminals to which the respective wires 44, 48 are connected.

A ground conductor in the form of an ground element 50 is formed by stamping and bending from metal plate. This has a planar central generally planar strip-like portion 52, with projections 54 extending outwardly from one edge. These projections 54 are received in openings in the printed circuit board 26, at locations between the two connectors 28, and soldered or otherwise electrically connected to tracks on the printed circuit board 26, so that the portion 52 extends outwardly from the rear face of the printed circuit board 26, in outstanding relationship to the printed circuit board 26 and between the connectors 28.

At its ends, the ground element 50 has transversely bent-out somewhat planar portions 60, these having at one free end of each a tongue-like mounting portion 62 with an aperture 64. These portions 62 are inserted into slots 66 at the rear of the body 10, and at each end of the body 10, so that the mounting portions 62 cooperate with internal retaining elements (not shown) in the slots 66 to retain the mounting portions 62 and securely but releasably mount the element 50 to the body 10. For example, the slots 66 may have internal latching projections which snap fit into the apertures 64 for this purpose.

Figure 2:
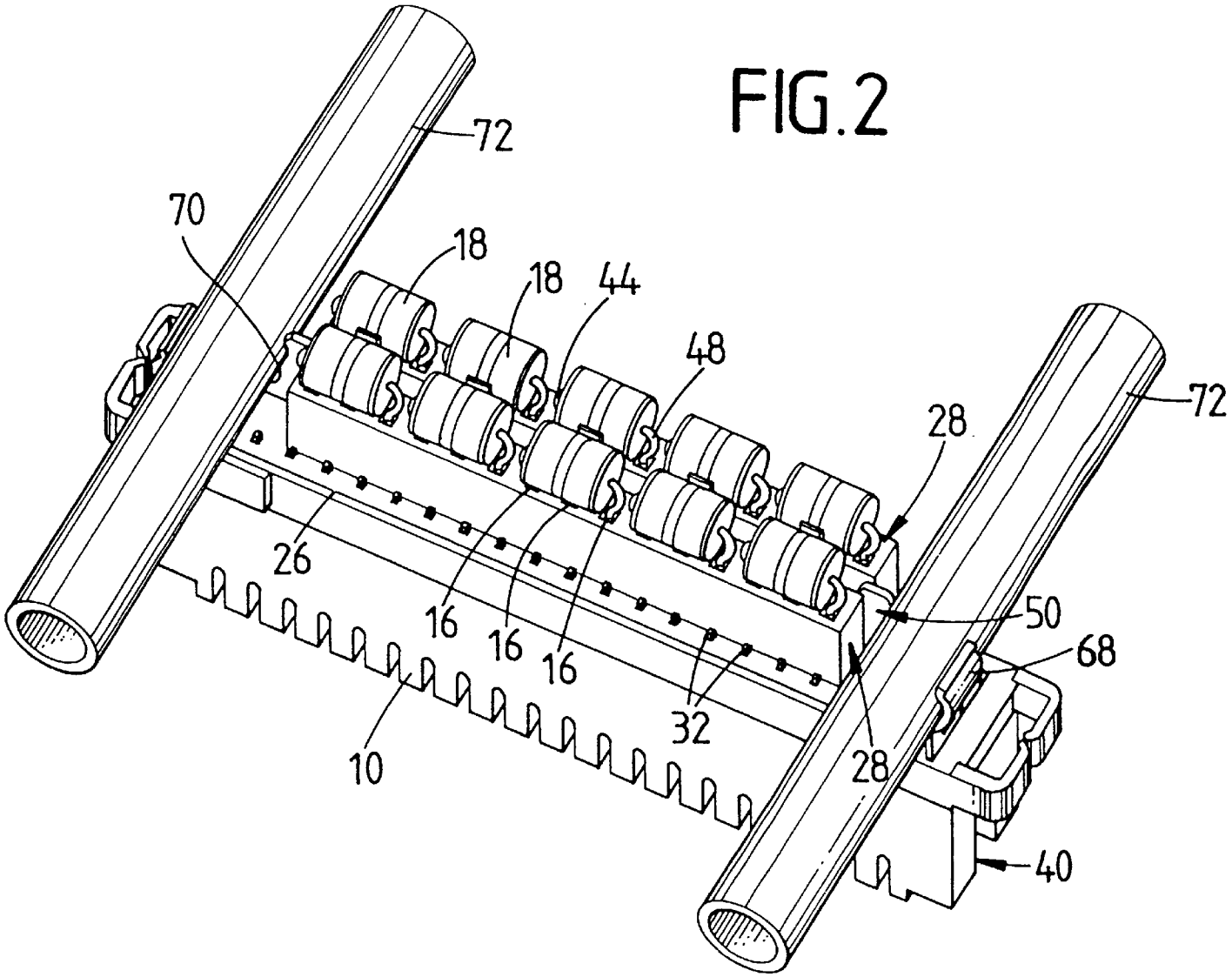
FIG. 2 is a rear perspective view of the connector and support structure of FIG. 1.
Figure 3:
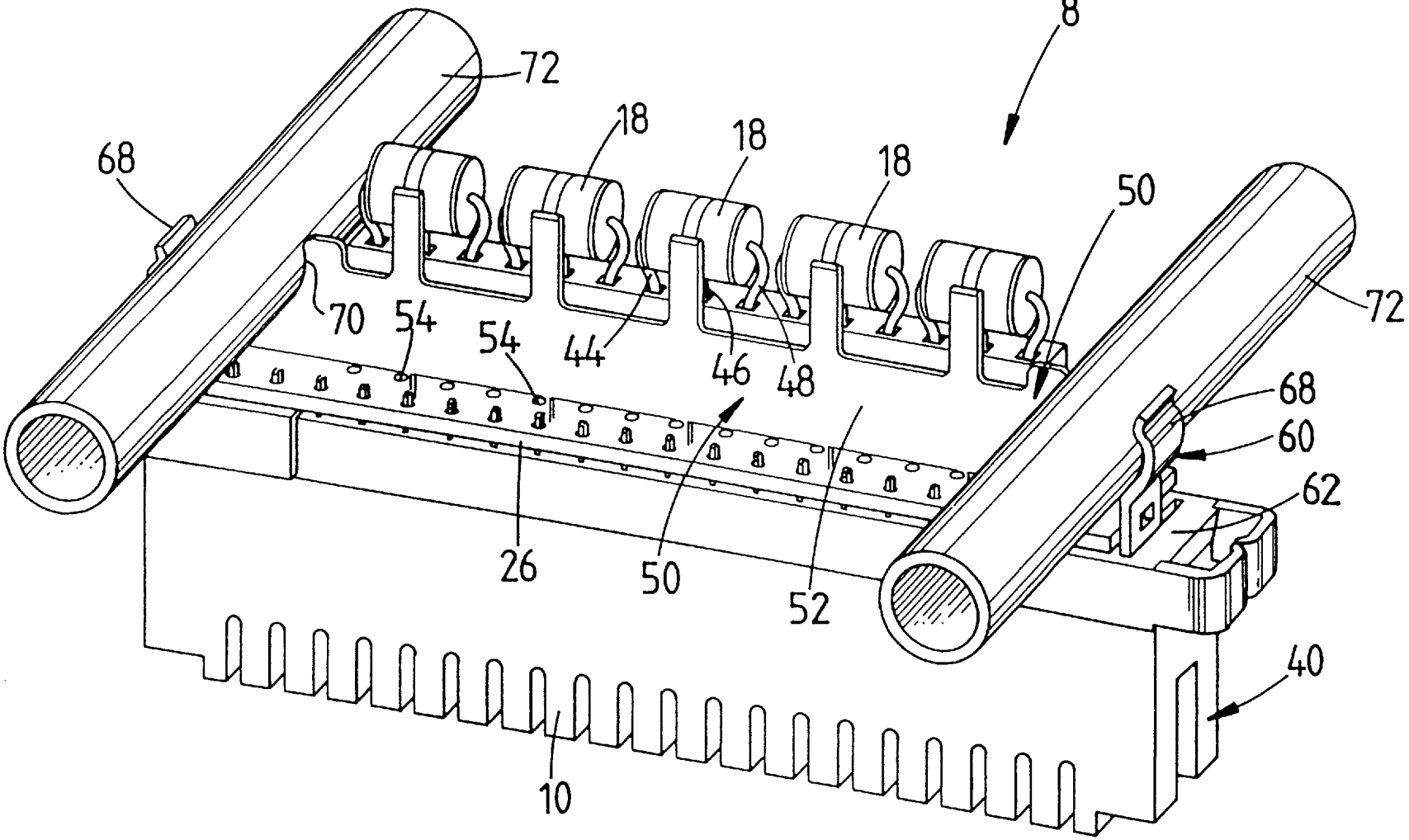
FIG. 3 is a view somewhat like FIG. 2, but with one component of the connector removed to show connections to an ground element, within the connector.

The planar portions 60 also define, at ends opposite the mounting portions 62, resilient gripping portions 68 which extend outwardly and rearwardly on the connector 8. These gripping portions 68 cooperate with respective adjacent but spaced edge portions 70 of the element 50, formed by cut-outs at the ends of the portion 52, to enable releasable resilient gripping of the parallel rails 72 of the support structure 22, as shown in FIGS. 2 and 3. Thus, each gripping portion 68 and its adjacent opposed edge portion 70 constitutes a respective releasable mounting means 20 for releasably mounting the connector 8 to the structure 22.

A rear cover 30 is provided, which is positionable over the planar portion 52 of the element 50, the printed circuit board 26, the connectors 28 and devices 18. Cover 30 rests against the rear of the body 10 and is held in position, when the connector is coupled to the rails 72 of the support structure 22, by clamping of end extensions 32 of the cover between the rear of 30 the body 10 and the rails. The cover 30 has end slots 34 at which the edge portions 70 of the planar portion 52 of the element 50 are exposed, so that these can engage the rails 72 for gripping in conjunction with the gripping portions 68.

Figure 4:
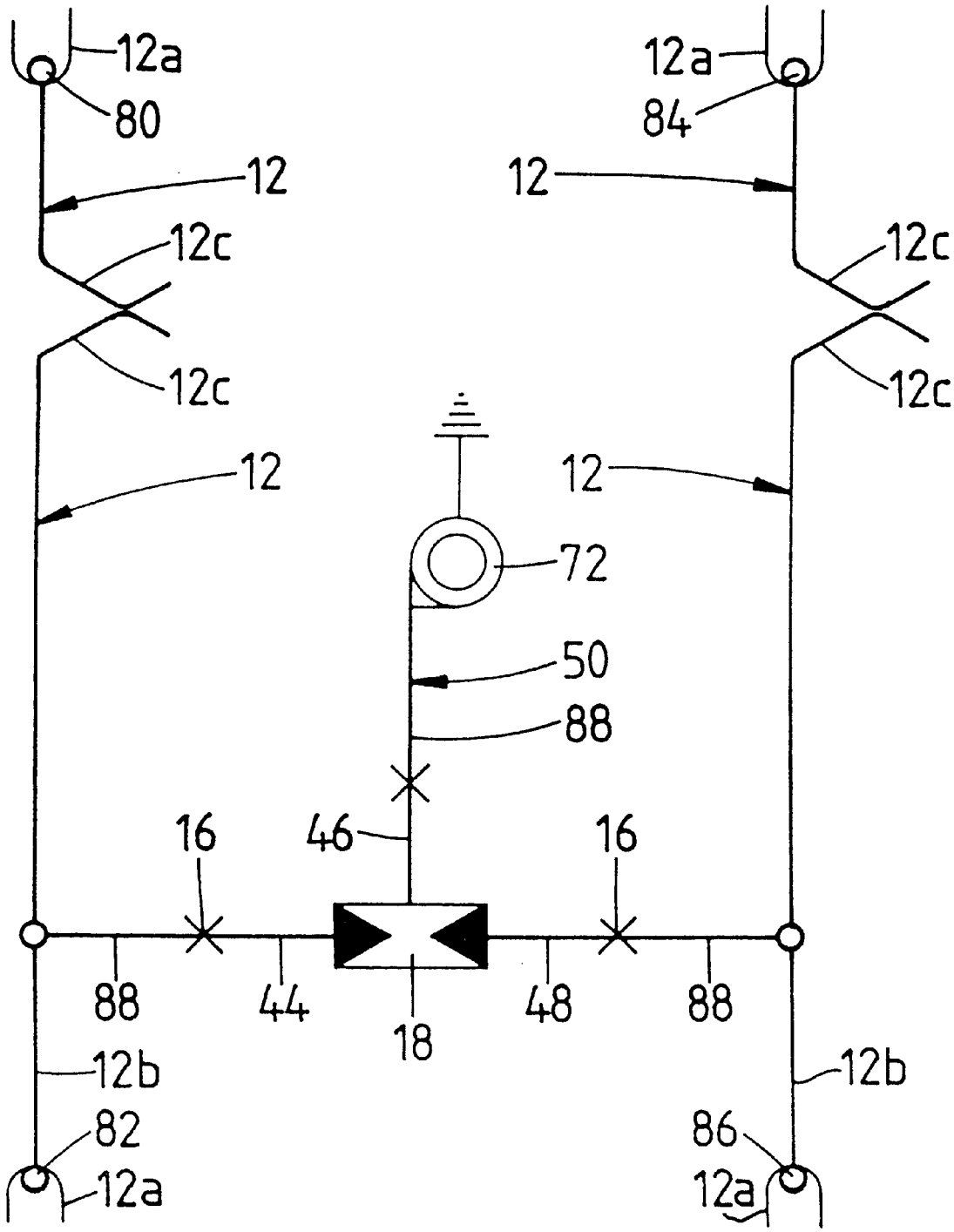
FIG. 4 is a diagram illustrating electrical connections within the connector of FIG. 1.

The electrical interconnections within and to and from the connector 8 when in use are diagrammatically represented in FIG. 4, which shows wire conductors 82, 86 of an incoming circuit pair connected to adjacent "incoming" terminals 12 in one row of the terminals 12 on body 10, and wire conductors 80, 84, of an "outgoing" circuit pair connected to adjacent "outgoing" terminals 12 in the other row of the terminals 12 on body 10. The connections to the conductors 80, 82, 84, 86 are made at insulation displacement contact portions 12*a* of the terminals 12. The circuit board tracks, on circuit board 26, are represented diagrammatically by reference numerals 88. Certain of these tracks interconnect from body portions 12*b* of contacts 12 in the "incoming" row thereof to the terminals 16 and thus with the wires 44, 48 of the devices 18 as shown. Also, the wires 46 of the devices 18 connect via further printed circuit board tracks (or trace) 88 to the element 50 and thence to the rails 72 of the support structure 22.

In use, electrical interconnections may be made between wires connected to the terminals 12 as may be needed to suit the set up of required communications circuits. This may be easily accomplished at the front of the connector without interference or inconvenience as may occur if the over-voltage protection devices were to be positioned at the front of the connector. On the other hand, access to the devices 18 can be readily gained, when required, by unclipping the connector 8 from the rails 72 and removal of the cover. The devices 18 may be readily removed from the connectors 28 by applying manual force to pull the wires from the terminals 16.

The illustrated body 10 and terminals 12 constitute a so-called "disconnection module" 40, the terminals in each row of these being releasably electrically coupled to respective associated opposite terminals 12 in the other row. This coupling is effected by resilient engagement of spring portions or resilient contact portions 12*c* (FIG. 4) of the terminals 12 in one row with 30 corresponding spring portions 12*c* of the terminals in the other row. The portions 12*c* are positioned in a lengthwise extending trough in the front of the connector body, to be accessible to enable selective disconnection of the electric coupling between each of the terminals of one row from the respective associated terminals 12 in the other row, by positioning, for example, insulative plugs or test plugs between the portions 12*c*, so that the portions 12*c* are forced apart against natural resilient bias of these. The test plugs and/or insulative plugs can be readily inserted and removed, as required by virtue of the over-voltage protection devices being positioned at the back of the connector. Further, it should be appreciated that any other type of terminal device may be employed for connection with the terminals 12 of the connector, in place of the insulative or test plugs.

The described arrangement has been advanced merely by way of explanation any many modifications may be made thereto without departing from the spirit and scope of the invention which includes every novel feature and combination of features herein disclosed. While specific embodiments of the invention have been shown and described in detail to illustrate the application of the principles of the invention, it will be understood that the invention may be embodied otherwise without departing from such principles.

APPENDIX

List of reference symbols

8 Electrical connector
10 Insulative body
12 Connector terminals
12*a* Insulation displacement contact portions (of contacts 12)
12*b* Body portions (of contacts 12)
12*c* Spring portions (of contacts 12)
14 Mounting assembly
16 Mounting assembly terminals
18 Over-voltage protection devices
20 Releasable mounting means
22 Support structure
24 Insulative structure
26 Printed circuit board
28 Over-voltage device connectors
30 Cover
32 End extensions (of cover 30)
34 Slots 34 (in cover 30)
38 Insulative bodies (of connector 30)
40 Disconnection module
44 Wire (of the over-voltage protection devices)
46 Wire (of the over-voltage protection devices)
48 Wire (of the over-voltage protection devices)
50 Ground element
52 Planar portion (of element 50)
54 Projections (on element 50)
60 Transversely bent out planar portions (on element 50)
62 Mounting portions (on element 50)
64 Aperture (on element 50)
66 Slots (on body 10)
68 Gripping portions (on element 50)
70 Edge portion (on element 50)
72 Rails
74 Cavities (on body 10)
80 Wire conductor (outgoing)
82 Wire conductor (incoming)
84 Wire conductor (outgoing)
86 Wire conductor (incoming)
88 Tracks (on circuit board 26)

What is claimed is:

1. An electrical connector, comprising:

connector terminals at a front of the connector to which external electrical conductors may be secured to make electrical connections between the conductors and said connector terminals;

a housing with a front side and a rear side and with said terminals mounted therein with access for connection to said terminals at said front side;

a releasable mounting device having a gripping portion which enables releasable resilient gripping of a support structure, said releasable mounting device being connected to said housing for releasable connection of the connector to said support structure for the connector;

over-voltage protection device assembly positioned at a rear of the connector and connected to said releasable mounting device to form a mounting assembly with over-voltage protection devices coupled electrically to corresponding said connector terminals for providing over-voltage protection to electrical circuits in use coupling to said external conductors via said connector terminals, said over-voltage protection devices being secured to said housing rear side, wherein said housing permits access to said terminals and said over-protection devices.

2. The electrical connector as claimed in claim 1, wherein the releasable mounting device is at least in part formed by a conductive ground element, which in use of the connector makes releasable electrical connection to the support structure, said over-voltage protection device assembly including a circuit board connecting said over-voltage protection devices to said connector terminals, said conductive ground element being connected to said circuit board such that an electrical ground path is formed from the connector to a grounded conductive portion of the support structure.

3. The electrical connector as claimed in claim 1, wherein said housing comprises an insulative body, wherein said connector terminals are carried by said insulative body of the connector, said mounting assembly having mounting assembly terminals electrically connected to corresponding ones of said connector terminals, said mounting assembly being adapted to receive the over-voltage protection devices so that the over-voltage protection devices connect to the mounting assembly terminals such that the over-voltage protection devices are coupled to said terminals via said mounting assembly terminals.

4. The electrical connector as claimed in claim 3, wherein said mounting assembly has an insulative structure and a circuit board, said mounting assembly terminals being carried by said insulative structure and being electrically coupled to conductive tracks of said circuit board, said conductive tracks being electrically coupled to said connector terminals.

5. The electrical connector as claimed in claim 3, wherein said mounting assembly has an electrically conductive ground element provided coupled to the releasable mounting device to provide an ground connection to the over-voltage protection devices.

6. The electrical connector as claimed in claim 5, wherein said ground element is part of said releaseable mounting device and has gripping portions which are adapted to releasably grip the support structure to effect the releasable connection of the connector to the support structure, wherein said ground element is arranged to releasably connect to said insulative body of the connector.

7. The electrical connector as claimed in claim 6, wherein said gripping portions are resilient and positioned adjacent to respective opposed portions of the connector, such that parts of the support structure may be resiliently gripped between the gripping portions and the opposed portions of the connector.

8. The electrical connector as claimed in claim 7, wherein said opposed portions are formed on said ground element so that each gripping portion and its opposed portion define therebetween a respective rearwardly facing opening for receiving a respective part of the support structure.

9. An electrical connector as claimed in claim 6, wherein a gripping portion and an associated said opposed portion of said ground element are provided at each end of said ground element.

10. The electrical connector as claimed in claim 3, further comprising a cover covering the rear of the connector.

11. The electrical connector as claimed in claim 10, wherein said cover is releasably attached to said insulative body of said connector.

12. An electrical connector as claimed in claim 3, wherein said insulative body of the connector and said connector terminals form parts of a disconnection module, said connector terminals being arranged in two parallel rows so that pairs of the first terminals, each comprising one said connector terminal in one row and an opposed said connector terminal in the other row, are defined, the first terminals having respective resilient contact portions, the resilient contact portions of the first terminals in each pair thereof being arranged so that in a first condition thereof they are resiliently biased into electrical contact with each other but, in a second condition thereof, are displaced out of direct electrical contact, by insertion of an electrically insulative element therebetween so that they are forced apart against the resilient bias.

13. The electrical connector as claimed in claim 12, wherein only said connector terminals in one row of said connector terminals are arranged to be coupled to the over-voltage devices.

14. The electrical connector as claimed in claim 3, wherein the releasable mounting device is at least in part formed by a conductive ground element, which in use of the connector makes releasable electrical connection to the support structure such that an electrical ground path is formed from the connector to a grounded conductive portion of the support structure and wherein two spaced parallel rows of said mounting assembly terminals are provided, with an elongate portion of the ground element being positioned to extend parallel to and between the rows.

15. The electrical connector as claimed in claim 14, wherein said elongate portion has projections which connect to conductive tracks on the circuit board and thence via those tracks to corresponding ones of said mounting assembly terminals.

16. An electrical connector, comprising:

connector terminals;

a housing supporting said terminals and having terminal access slots at a connector front side and having an opposite rear side, external electrical conductors being securable to said terminals via said slots to make electrical connections between the conductors and said connector terminals;

a mounting assembly connected at a rear side of the connector, said mounting assembly including over-voltage protection devices and a releasable mounting device for releasable attachment of said housing to a support structure for the connector, said releasable mounting device being connected to said over-voltage protection devices and to said housing, said over-voltage protection devices being mounted to said housing rear side, said over-voltage protection devices being coupled electrically to corresponding said connector terminals for providing over-voltage protection to electrical circuits via said connector terminals and the external conductors.

17. An electrical connector as claimed in claim 16, wherein the support structure is spaced rails.

18. An electrical connector as claimed in claim 17, wherein said mounting assembly includes a circuit board conneting said over-voltage protection devices to said contact terminals and said releasable mounting device includes a ground element positioned at said rear side of said housing connected to said contact terminals and said over-voltage protection devices via said circuit board and connected to said spaced rails.

19. An electrical connector, comprising:

connector terminals;

a housing supporting said terminals and having terminal access slots at a connector termination side and having an opposite side, external electrical conductors being securable to said terminals via said slots to make electrical connections between the conductors and said connector terminals;

a plurality of over-voltage protection devices connected to respective connector terminals, said over-voltage protection devices being mounted to said housing at said opposite side;

a releasable mounting device for releasable attachment of said housing to a support structure, said releasable mounting device being connected to said housing and extending from said housing opposite side.

20. An electrical connector as claimed in claim 19, wherein the support structure is spaced rails.

* * * * *